US006530827B2

(12) United States Patent
Mitsuhashi

(10) Patent No.: US 6,530,827 B2
(45) **Date of Patent: *Mar. 11, 2003**

(54) APPARATUS FOR POLISHING WAFER AND METHOD OF DOING THE SAME

(75) Inventor: Masashige Mitsuhashi, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/754,191

(22) Filed: Jan. 5, 2001

(65) Prior Publication Data

US 2001/0007809 A1 Jul. 12, 2001

(30) Foreign Application Priority Data

Jan. 6, 2000 (JP) ..... 2000-000569

(51) Int. Cl.[7] ..... B24B 7/00
(52) U.S. Cl. ..... 451/72; 451/443; 451/288
(58) Field of Search ..... 451/56, 72, 41, 451/285, 286, 287, 288, 443, 444

(56) References Cited

U.S. PATENT DOCUMENTS 5,584,749 A * 12/1996 Mitsuhashi et al. ..... 451/285
5,885,137 A * 3/1999 Ploessl ..... 451/56
6,039,635 A * 3/2000 Mitsuhashi et al. ..... 451/72
6,099,393 A * 8/2000 Katagiri et al. ..... 451/56

FOREIGN PATENT DOCUMENTS

| | | |
|---|---|---|
| JP | 5-69310 | 3/1933 |
| JP | 5-309559 | 11/1993 |
| JP | 7-105369 | 11/1995 |
| JP | 9-11117 | 1/1997 |
| JP | 11-48122 | 2/1999 |
| JP | 11-179648 | 7/1999 |

* cited by examiner

*Primary Examiner*—George Nguyen
*Assistant Examiner*—Dung Van Nguyen
(74) *Attorney, Agent, or Firm*—Young & Thompson

(57) ABSTRACT

An apparatus for polishing an object, includes (a) a rotatable circular polishing plate (11) having a polishing surface on which an object (12) is to be polished, (b) a pressurizer (21) which applies a pressure to an object (12) to make the object (12) contact with the polishing surface, (c) a first unit (13) which supplies polishing solution containing abrasive, to the polishing surface, (d) a dresser (23) which dresses the polishing surface, and (e) a second unit (14) which is located downstream of the dresser (23) and upstream of the first unit (13) in a direction of rotation of the polishing plate (11) and which has an absorption surface (31) through which the second unit sucks the polishing solution from the polishing surface, the absorption surface (31) being formed thereon with a plurality of pivots (35).

34 Claims, 6 Drawing Sheets

APPARATUS FOR POLISHING WAFER AND METHOD OF DOING THE SAME

BACKGROUND OF THE INVENTION

1. Field of the Invention

The invention relates to an apparatus for polishing an object in the form of a plate, such as a semiconductor wafer, a wafer covered with an insulating film in a semiconductor circuit, a wafer on which a metal wire is formed, a magnetic disc or a glass substrate. The invention relates further to a method of doing the same.

2. Description of the Related Art

There have been suggested many apparatuses and methods for polishing an object in the form of a plate, such as a semiconductor wafer, a magnetic disc or a glass substrate.

For instance, Japanese Unexamined Patent Publication No. 5-69310 has suggested an apparatus for polishing an object, including a flexible resilient film on which a wafer lies.

Japanese Unexamined Patent Publication No. 5-309559 has suggested an apparatus and a method of polishing an object, in which a laser beam is radiated to an object, a reflected laser beam is received, and then, a thickness of the object is measured based on the reflected laser beam.

Japanese Unexamined Patent Publication No. 7-105369 has suggested a method including the steps of a coating an organic resist containing a specific molecule, pigment or chemical compound therein, onto a substrate, analyzing used polishing solution, detecting the molecule, pigment and chemical compound, controlling a rotation speed, a load pressure, and a location of an apparatus of polishing an object based on the results of detection.

Japanese Unexamined Patent Publication No. 9-11117 has suggested an apparatus including a dresser for dressing a polishing cloth with which an object is to be polished. The dresser is positioned in a direction of a radius of a polishing plate supporting the polishing cloth therewith.

Japanese Unexamined Patent Publication No. 11-179648 has suggested an apparatus of polishing an object, including a conditioner, and absorbers positioned around the conditioner. Dust generated as the result of conditioning a polishing pad is collected by the absorbers.

Japanese Unexamined Patent Publication No. 11-48122 has suggested an apparatus of polishing an object, including a first dresser and a second dresser. The first dresser grinds and hence planarizes a surface of a polishing pad. Thereafter, the polishing pad is dressed by the second dresser comprised of a cylindrical brush, to thereby recover an original rough grain.

FIG. 1 is a side view of a conventional apparatus of polishing an object, similar to the apparatuses suggested in the above-mentioned Publications.

In operation of the apparatus, an object 132 is kept lied on a surface of a circular polishing plate 131 under a pressure by means of a holder 133. While the polishing plate 131 is being rotated, polishing solution 134 containing abrasive is supplied to a surface of the polishing plate 131 to thereby polish the object 132.

FIG. 2 is a graph showing a relation between a polishing rate and a period of time in which the object 132 is polished, in the apparatus illustrated in FIG. 1. Herein, the polishing rate is defined as A/B wherein A indicates a polished amount of the object and B indicates a polishing time. As is obvious in view of FIG. 2, as the polishing time becomes longer, the polishing rate becomes smaller, because a surface of the polishing plate 131 is covered with particles generated by polishing the object 132. Thus, the conventional apparatus illustrated in FIG. 1 is accompanied with a problem that objects are polished in different degrees.

In addition, since polishing solution used for polishing the object 132 is wasted each time the object 132 is polished, the conventional apparatus is accompanied with another problem that running costs are unavoidably high.

Hence, the inventor of the present invention has suggested an apparatus for polishing an object, in Japanese Unexamined Patent Publication No. 11-70459, including a rotatable circular polishing plate having a polishing surface on which an object is to be polished, a pressurizer which applies a pressure to an object to make the object contact with the polishing surface, a first unit which is located upstream of the object in a direction of rotation of the polishing plate and which supplies polishing solution containing abrasive, to the polishing surface, a dresser which is located downstream of the object in a direction of rotation of the polishing plate and which dresses the polishing surface, and a second unit which is located downstream of the dresser and upstream of the first unit in a direction of rotation of the polishing plate and which has an absorption surface through which the second unit sucks the polishing solution from the polishing surface.

In practical use, the apparatus works better than the conventional apparatus illustrated in FIG. 1. However, the apparatus has the following problems.

Firstly, it is necessary to keep a gap between the absorption surface and the polishing surface to be equal to or smaller than 1 mm in order to ensure a sufficient ability of the second unit to absorb the polishing solution. However, if the polishing plate is worn and hence the gap becomes greater, an ability of the second unit to absorb the polishing solution is reduced.

Secondly, each time the polishing plate is exchanged to a new one, it takes much time to properly set the second unit, resulting in deterioration in productivity.

SUMMARY OF THE INVENTION

In view of the above-mentioned problems in the conventional apparatuses, it is an object of the present invention to provide an apparatus and a method of polishing an object, both of which can keep a sufficient ability of the second unit to absorb polishing solution, even if the polishing plate is worn, and which makes it easier to properly set the second unit.

In one aspect of the present invention, there is provided an apparatus for polishing an object, including (a) a rotatable circular polishing plate having a polishing surface on which an object is to be polished, (b) a pressurizer which applies a pressure to an object to make the object contact with the polishing surface, (c) a first unit which is located upstream of the object in a direction of rotation of the polishing plate and which supplies polishing solution containing abrasive, to the polishing surface, (d) a dresser which is located downstream of the object in a direction of rotation of the polishing plate and which dresses the polishing surface, and (e) a second unit which is located downstream of the dresser and upstream of the first unit in a direction of rotation of the polishing plate and which has an absorption surface through which the second unit sucks the polishing solution from the polishing surface, the absorption surface being formed thereon with a plurality of pivots.

In accordance with the apparatus, since the absorption surface of the second unit is designed to have a plurality of pivots, it would be necessary to keep a gap between the absorption surface and the polishing surface equal to a height of the pivots. Thus, the second unit could be readily set each time the polishing plate is exchanged to a new one.

It is preferable that each of the pivots has a rounded summit. This ensures smooth contact between the pivots and the polishing surface of the polishing plate.

Though the pivots may be formed anywhere on the absorption surface, it is preferable that the pivots are formed at four corners of the absorption surface.

This ensures a widest area of the absorption surface.

The pivots may be composed of any material. For instance, the pivots may be composed of Teflon.

The absorption surface may be comprised of a first area facing an inner area of the polishing surface, a second area facing an outer area of the polishing surface entirely surrounding the inner area, and an intermediate area located between the first and second areas, the first area having absorption holes in a greater number than the intermediate area and the second area having absorption holes in a greater number than the intermediate area. The polishing solution is absorbed into the second unit through the absorption holes.

The rotating polishing plate exerts a centrifugal force on the polishing solution, and accordingly, the polishing solution tends to flow radially outwardly of the polishing plate. Hence, by forming the absorption holes in the first and second areas in a greater number than the intermediate area, it would be possible to effectively absorb the polishing solution, in particular, in an outer area of the polishing surface facing the second area.

It is preferable that the absorption surface is formed at opposite edges thereof with a plurality of recesses in a direction of rotation of the polishing plate.

Such recesses could catch the polishing solution flowing towards a periphery of the polishing plate by a centrifugal force exerted by the rotating polishing plate.

It is preferable that the absorption surface is rounded or chamfered at opposite edges thereof in a direction of rotation of the polishing plate.

This ensures that, even if the second unit makes direct contact with the polishing surface of the polishing plate, it would be possible to prevent both the second unit and the polishing plate from being damaged.

The apparatus may further include a unit for rotating the dresser around a center of the dresser.

The unit makes is possible to vary a relative speed between the polishing surface of the polishing plate and a dressing surface of the dresser, and to rotate the dresser in a direction opposite to a direction in which the polishing plate rotates, thereby adjusting a degree of dressing the polishing surface.

The apparatus may further include a unit for upwardly or downwardly moving the second unit relative to the polishing surface.

The unit ensures that a gap between the absorption surface and the polishing surface is kept constant, even if a polishing pad equipped in the polishing plate is worn. The unit may be comprised of a screw or a combination of a motor and a screw automatically rotated by the motor.

The apparatus may further include an annular wall standing along a periphery of the polishing plate and rotatable together with the polishing plate, and a third unit which is located inside the annular wall and in the vicinity of an inner surface of the annular wall and which collects the polishing solution.

The annular wall facilitates collection of the polishing solution and capture of debris generated by polishing an object, and the third unit surely removes the polishing solution having been not absorbed by the second unit.

It is preferable that the second unit and the dresser are integrally supported on the polishing surface so that the second unit and the dresser are rotatable together in a direction of rotation of the polishing plate.

Since the second unit and the dresser are rotatable on the polishing surface, it would be possible to uniformly dress the polishing surface and uniformly absorb the polishing solution, as the polishing plate rotates.

It is preferable that the apparatus further includes a fourth unit which reciprocates the second unit and the dresser together in a direction of a radius of the polishing plate.

As an alternative, the second unit may have a length equal to a radius of the polishing surface, and the second unit lies above the polishing plate entirely over a radius of the polishing surface.

As an alternative, the dresser may have a length equal to a radius of the polishing surface, and the dresser lies on the polishing plate entirely over a radius of the polishing surface.

The fourth unit, the second unit having such a length or the dresser having such a length would make it possible to absorb the polishing solution over an entire radius of the polishing surface, ensuring that any object can be polished under the same conditions regardless of a size of the object.

It is preferable that the apparatus further includes a fifth unit which filters the polishing solution having been absorbed by the second unit, and supplies the thus filtered polishing solution to the first unit.

The fifth unit makes it possible to recycle the polishing solution, and hence, ensures reduction in running costs of the apparatus.

There is further provided an apparatus for polishing an object, including (a) a rotatable circular polishing plate, (b) a pressurizer which applies a pressure to an object to make the object contact with the polishing surface, (c) a first unit which is located upstream of the object in a direction of rotation of the polishing plate and which supplies polishing solution containing abrasive, to the polishing surface, and (d) a dresser which is located downstream of the object in a direction of rotation of the polishing plate and which dresses the polishing surface, the dresser including a second unit having an absorption surface through which the second unit sucks the polishing solution from the polishing surface, the absorption surface being formed thereon with a plurality of pivots.

In accordance with the apparatus, it would be possible to firstly dress the polishing surface of the polishing plate by the dresser, and secondly, absorb the polishing solution by the second unit integrally formed with the dresser.

For instance, the dresser may be in the form of a circle.

The dresser may be formed of a circular plate in which a dressing surface of the dresser and the absorption surface are radially and alternately arranged.

Since the dressing surface and the absorption surface are radially alternately arranged, dressing the polishing surface and absorbing the polishing solution and debris are repeatedly cyclically carried out.

The dresser may be formed of a circular plate in which the absorption surface is arranged in an inner area of the circular plate and a dressing surface of the dresser is arranged in an outer area surrounding the inner area of the circular plate.

Since the absorption surface and the dressing surface are arranged adjacent to each other, dressing the polishing surface and absorbing the polishing solution and debris are concurrently carried out.

The dresser may be formed of a circular plate in which a dressing surface of the dresser and the absorption surface are coaxially and alternately arranged.

Since the absorption surface and the dressing surface are coaxially arranged, dressing the polishing surface and absorbing the polishing solution and debris are repeatedly cyclically carried out.

The dresser may be formed of a cylinder, a dressing surface of the dresser extending in an axial direction of the cylinder and the absorption surface extending in an axial direction of the cylinder being alternately arranged on an outer surface of the cylinder.

Since the dressing surface and the absorption surface are alternately arranged in an outer surface of the cylinder, when the cylinder rotates, dressing the polishing surface and absorbing the polishing solution and debris are repeatedly cyclically carried out.

The dresser may be formed of a circular plate in which a plurality of the dressers are arranged on a certain circumference and an area other than the dressers is formed as absorption surface.

By using the dresser, dressing the polishing surface and absorbing the polishing solution and debris are concurrently carried out.

It is preferable that a dressing surface of the dresser projects beyond the absorption surface, preferably, by 1 mm or smaller.

By designing the dressing surface to project beyond the absorption surface, it would be possible to properly dress the polishing surface and absorb the polishing solution.

In another aspect of the present invention, there is provided a method of polishing an object, comprising the steps of (a) causing an object to make a contact with a polishing surface of a rotating polishing plate under pressure, and supplying polishing solution containing abrasive, to the polishing surface at a first location upstream of the object in a direction of rotation of the polishing plate, (b) digging the polishing solution from the polishing surface at a second location downstream of the object in a direction of rotation of the polishing plate, and (c) sucking the polishing solution from the polishing surface at a location downstream of the second location and upstream of the first location in a direction of rotation of the polishing plate.

In accordance with the method, the polishing solution is dug from the polishing surface by the dresser at a location downstream of the object, and the thus dug polishing solution is absorbed by the second unit, while the object is being polished. Hence, the polishing solution and debris of both the object and the polishing plate are removed in an in-process manner, ensuring that the polishing surface are kept clean.

The steps (b) and (c) may be concurrently carried out.

The method may further include the steps of filtering the polishing solution having been sucked in the step (c), and supplying the thus filtered polishing solution to the polishing surface.

This ensures that the polishing solution is filtered, and then, the thus filtered polishing solution is supplied again to the polishing surface. Hence, the polishing solution can be repeatedly used, ensuring reduction in running costs. In addition, it would be possible to reduce an environmental load to be caused by wasting the polishing solution.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Figure 1:
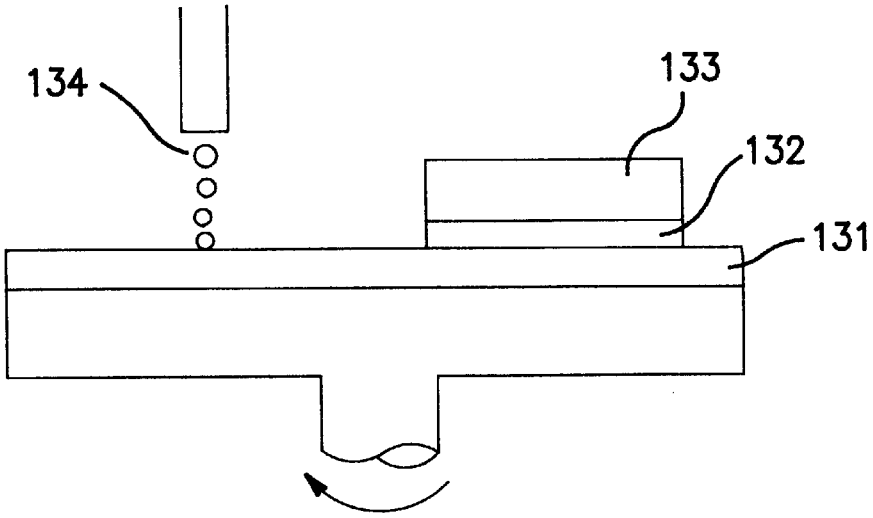
FIG. 1 PRIOR ART
FIG. 1 is a side view of a conventional apparatus for polishing an object.
Figure 2:
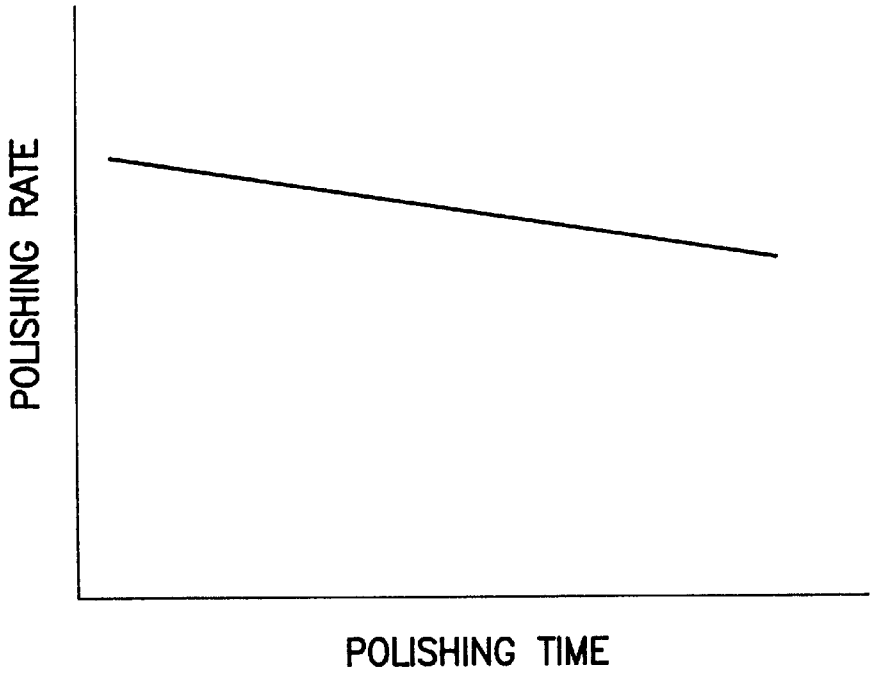
FIG. 2 PRIOR ART
FIG. 2 is a graph showing relation between the polishing rate and the polishing time in the apparatus illustrated in FIG. 1.
Figure 3:
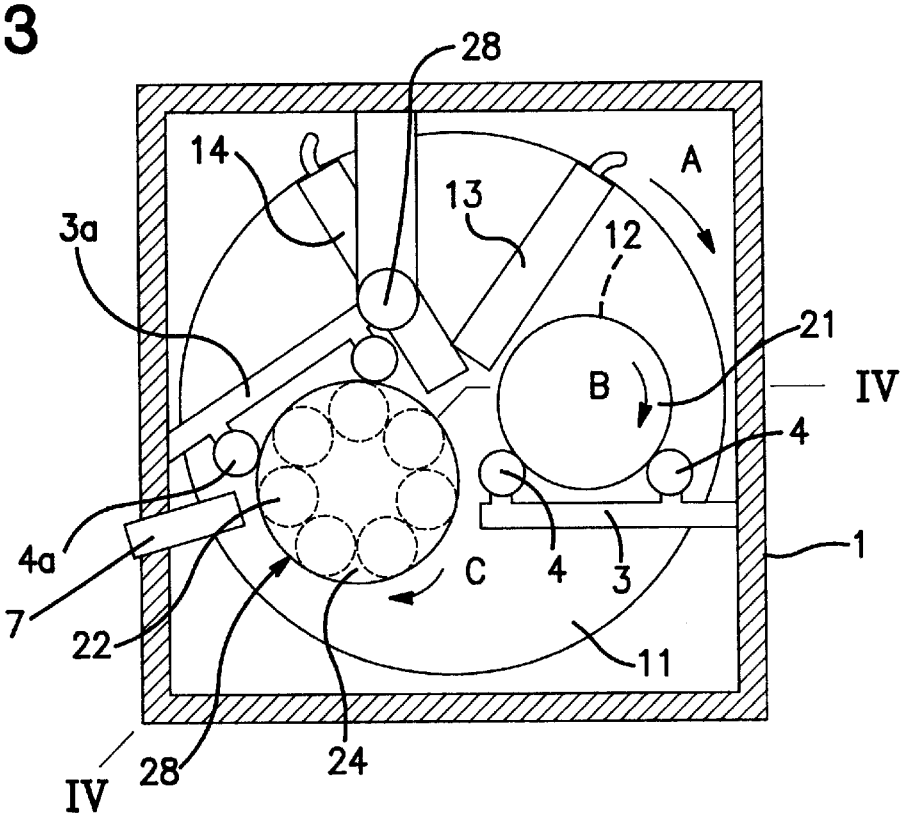
FIG. 3 is a plan view of an apparatus for polishing an object, in accordance with the first embodiment of the present invention.
Figure 4:
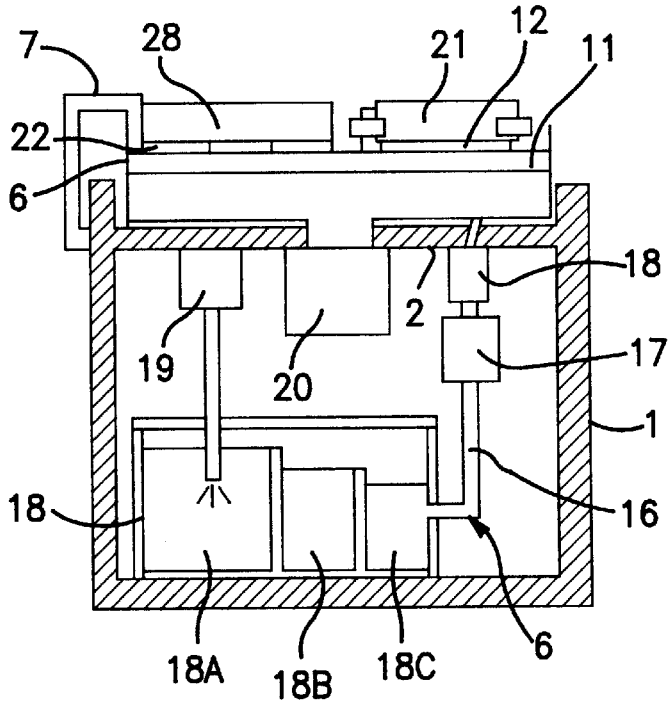
FIG. 4 is a cross-sectional view taken along the line IV—IV in FIG. 3.

FIGS. 3 and 4 illustrate an apparatus for polishing an object, in accordance with the first embodiment.

As illustrated in FIG. 4, the apparatus includes a box-type container 1 formed slightly below an upper edge thereof with a support plate 2 having an opening at a center thereof.

A circular polishing plate 11 is mounted for rotation on the support plate 2 such that a polishing surface of the polishing plate 11 upwardly faces. The polishing plate 11 is rotated by a motor 20 in a direction indicated with an arrow "A" in FIG. 3, that is, in a clockwise direction when viewed from upward.

A holder 21 applies a pressure to an object 12 so that the object 12 is kept to make close contact with the polishing surface of the polishing plate 11. The holder 21 and the object 12 are kept located at a fixed position on or above the polishing surface by support rollers 4 such that the holder 21 and the object 12 can be rotated together around centers thereof. The support rollers 4 are carried for rotation by a horizontal frame 3 located downstream of the, object 12 in a direction of rotation of the polishing plate 11, that is, in the direction A.

A rectangular parallelopiped first unit 13 and a rectangular parallelopiped second unit 14 are spaced away from and above polishing surface of the polishing plate 11 by a gap equal to or smaller than 1 mm. The first unit 13 sprays polishing solution containing abrasive, onto the polishing surface through a lot of holes formed at a bottom of the first unit 13. The second unit 14 absorbs the polishing solution from the polishing surface through a lot of holes formed at a bottom of the second unit 14.

A dresser 23 for dressing the polishing surface of the polishing plate 11 lie on the polishing surface.

Figure 5:
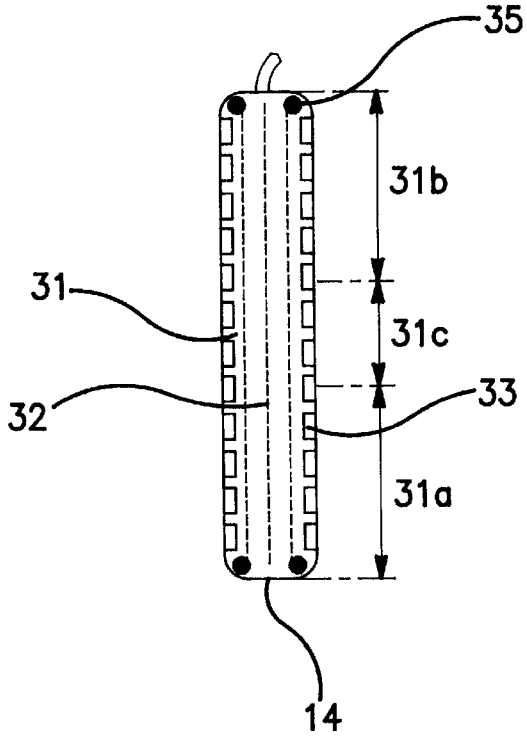
FIG. 5 is a bottom view of the second unit in the first embodiment.

FIG. 5 is a bottom view of the second unit 14, illustrating an absorption surface 31 of the second unit 14 through which the polishing solution is absorbed. As illustrated in FIG. 5, pivots 35 are formed at four corners of the absorption surface 31. Each of the pivots 35 is 0.8 mm high, is rounded at a summit thereof, and is composed of Teflon.

As illustrated in FIG. 3, the second unit 14 is equipped with a screw unit 28 driven by a motor (not illustrated). The screw unit 28 raises or lowers the second unit 14 relative to the polishing surface.

As illustrated in FIG. 3, the first unit is positioned upstream of the object in the direction A. The dresser 23 is positioned downstream of the object in the direction A. The second unit 14 is positioned downstream of the dresser 23 and upstream of the first unit 13 in the direction A. Namely, the second unit 14 is positioned between the dresser 23 and the first unit 13.

The first unit 13 has a length equal to a radius of the polishing surface, and hence, can spray the polishing solution entirely onto the polishing surface. The second unit 14 has a length equal to a radius of the polishing surface, and hence, can absorb the polishing solution entirely from the polishing surface. The dresser 23 has a diameter equal to a radius of the polishing surface, and hence, can dress a whole area of the polishing surface.

As illustrated in FIG. 4, an annular wall 6 stands along an outer periphery of the circular polishing plate 11. The annular wall 6 is designed to be able to rotate together with the polishing plate 11.

A third unit 7 having an opening through which the polishing solution is absorbed from the polishing surface is positioned such that the opening faces the polishing surface in the vicinity of the annular wall 6.

The first unit 13 is formed at a bottom thereof with a lot of holes each having a diameter of 1 mm, at a pitch of 3 mm.

As illustrated in FIG. 5, the polishing surface 31 is comprised of a first area 31*a* facing an inner area of the polishing surface, a second area 31*b* facing an outer area of the polishing surface entirely surrounding the inner area, and an intermediate area 31*c* sandwiched between the first and second areas 31*a* and 31*b*. The first and second areas 31*a* and 31*b* are designed to have absorption holes 32 three time greater in number than the intermediate area 31*c*. Each of the absorption holes 32 has a diameter of 1 mm.

As illustrated in FIG. 5, the absorption surface 31 of the second unit 14 is formed at opposite side edges thereof with a plurality of shallow recesses 33 at a certain pitch. Each of the recesses 33 has a depth of 1 mm or smaller. The recesses 33 capture the polishing solution flowing radially outwardly of the polishing plate 11 by a centrifugal force exerted thereon.

In addition, the absorption surface 31 is rounded at opposite side edges thereof. The rounded side edges have a radius of about 2 mm. The rounded side edges prevent the second unit 14 and the polishing plate 11 from being damaged, even if they make contact with each other. In stead of rounding the side edges of the absorption surface 31, the absorption surface 31 may be chamfered at opposite side edges thereof.

As illustrated in FIGS. 3 and 4, the dresser 23 is comprised of a circular base plate 24 and a plurality of circular grinding stones 22 fixed in a circle onto a bottom of the base plate 24. Each of the grinding stones 22 is composed of a mixture of natural diamond particles having a diameter of about 150 micrometers and artificial diamond particles having a diameter of about 100 micrometers.

The dresser 23 makes contact with the polishing surface under a pressure caused by its own weight. The dresser 23 is kept on the polishing surface at a fixed position downstream of the object 12 in the direction A by means of support rollers 4*a* carried for rotation by a horizontal frame 3*a* such that the dresser 23 can rotate around a center thereof.

Below the support frame 2 is arranged a fifth unit 5 which recycles the polishing solution having been absorbed and collected by the second and third units 14 and 7, and supplies the thus recycled polishing solution to the first unit 13.

The fifth unit 5 includes a polishing solution tank 18 and a filter 16 for removing foreign maters in the recycled polishing solution. The polishing solution tank 18 is comprised of first to third precipitators 18A, 18B and 18C. The collected polishing solution is first contained in the first precipitator 18A, and an overflow is introduced into the second precipitator 18B, and subsequently, into the third precipitator 18C. While the polishing solution is contained in the first to third precipitators 18A to 18C, foreign matters in the polishing solution are precipitated.

A partition wall between the first and second precipitators 18A and 18B is higher than a partition wall between the second and third precipitators 18B and 18C. Hence, an overflow is flown into the first, second and third precipitators 18A, 18B and 18C in turn.

The second and third units 14 and 7 are in fluid communication with the first precipitator 18A through a pump 19, and the third precipitator 18C is in fluid communication with a pump 17, the filter 16, and the first unit 13 through a pipe 15.

The pump 19 is powerful enough to absorb the polishing solution together with air from the second unit 14. The air absorbed by the pump 19 is exhausted outside by a unit (not illustrated) so as not to be introduced into the first precipitator 18A.

The pump 17 supplying the recycled polishing solution to the first unit 13 has a discharge of about 100 cc/min.

The filter 16 removes foreign matters which could not be removed by the first to third precipitators 18A, 18B and 18C. The filter 16 is comprised of a 50 $\mu$m-mesh and a 10 $\mu$m-mesh.

Hereinbelow is explained an operation of the apparatus in accordance with the first embodiment.

When the object 12 is to be polished by the polishing plate 11, the first unit 13 supplies the polishing solution onto the polishing surface of the polishing plate 11. The polishing solution supplied to the polishing surface upstream of the object 12 reaches the object 12 by virtue of the rotation of the polishing plate 11. The object 12 is polished by a frictional force generated between the polishing plate 11 and the object 12 by both the rotation of the polishing plate 11 in the direction A and the rotation of the object 12 in a direction indicated with an arrow "B".

After the polishing solution has passed the object 12, the dresser 23 located downstream of the object 12 dresses the polishing surface of the polishing plate 11, and resultingly the polishing solution is dug from the polishing surface. The thus dug polishing solution is absorbed by the second and third units 14 and 7 at once.

Since the absorption surface 31 of the second unit 14 is formed at four corners thereof with the rounded Teflon pivots 35, it would be possible to space the absorption surface 31 and the polishing surface from each other in accordance with a height (0.8 mm) of the pivots 35.

In addition, it would be possible to keep a gap between the absorption surface 31 and the polishing surface constant by lowering the second unit 14 by means of the screw unit 28 in accordance with worn-out or reduction in a thickness of the polishing plate 11.

The dresser 23 rotates around a center thereof in a direction indicated with an arrow "C" as the polishing plate 11 rotates. The polishing surface is dressed by a frictional force generated between the polishing surface and the diamond grinding stones 22 fixed on a bottom of the dresser 23.

Since the grinding stones 22 includes the natural diamond particles, the polishing surface can be sharply dressed by sharp edges of the natural diamond particles. Furthermore, since the grinding stones 22 are composed of a mixture of the natural and artificial diamond particles, fabrication costs of the dresser 23 can be reduced relative to a dresser composed only of natural diamond particles.

As mentioned above, the polishing surface is dressed by the dresser 23 in the apparatus in accordance with the first embodiment. Hence, even if the object 12 is highly pressurized onto the polishing surface by the holder 21, debris are surely dug from the polishing surface together with the polishing solution. Those debris can be removed in-process, ensuring that the polishing surface is kept clean.

As mentioned earlier, the first and second areas 31*a* and 31*b* facing the inner and outer areas of the polishing plate 11 are designed to have absorption holes 32 three time greater in number than the intermediate area 31*c*. Hence, it would be possible to effectively collect the polishing solution much gathering in the inner and outer areas of the polishing plate 11.

In addition, since the absorption surface 31 facing the polishing plate 11 is formed at opposite side edges thereof with the shallow recesses 33, it would be possible to capture the polishing solution flowing radially outwardly of the polishing plate 11 by a centrifugal force, by the recesses 33, ensuring effective absorption of the polishing solution.

Furthermore, since the absorption surface 31 is formed rounded at opposite side edges thereof, it would be possible to prevent the polishing plate 11 and the second unit 14 from being damaged, even if they collide with each other.

As mentioned so far, the apparatus in accordance with the first embodiment makes it possible to effectively polish the object 12 without reduction in a polishing rate. In accordance with the apparatus, the polishing solution is supplied to a whole area of the polishing surface and the polishing solution is absorbed from a whole area of the polishing surface, ensuring that any object 12 can be polished under the same conditions regardless of a size of the object 12.

The apparatus further enhances productivity, because the second unit 14 can be readily properly set each time the polishing plate 11 is exchanged to a new one.

In accordance with the apparatus, it would be possible to keep an absorption ability of the second unit 14 constant, even if the polishing plate 11 is worn.

The inventor conducted an experiment to confirm the above-mentioned advantages presented by the apparatus in accordance with the first embodiment.

In the experiment, there were used the polishing plate 11 having a diameter of 25 inches and composed of polyurethane, and colloidal silica having a particle diameter of 100 angstroms, as a polishing solution. A wafer on which a silicon dioxide film was formed was polished as the object 12. The polishing plate 11 was rotated at 24 rpm. The holder 21 applied a pressure of 60 kPa to the object 12.

As a result, the polishing rate was 2200±50 angstroms/min when the polishing time was equal to or smaller than 20 hours. This means that it was confirmed that the problem in the conventional apparatus that the polishing rate became smaller as the polishing time became longer when an object was compressed onto the polishing surface in a high pressure, was solved.

In addition, the second unit 14 could be properly set in a time five times smaller than a time necessary for the conventional apparatus to properly set the second unit 14.

It is considered that the advantages mentioned above are presented by the first unit 13, the dresser 23 and the second unit 14. That is, the reason why the advantages are provided by the apparatus is that the polishing solution supplied to the polishing surface while the object is being polished is dug from the polishing surface by the dresser 23 after having been used to polish the object 12, and then, is absorbed by the second unit 14 together with debris generated while the object 12 is polished with the polishing plate 11.

In addition, since the absorption 31 is formed at four corners thereof with the rounded pivots 35 and the second unit 14 is raised or lowered by the screw unit 28, a gap between the absorption surface 31 and the polishing surface could be readily set and be kept constant. This is one of the reasons why the above-mentioned advantages can be obtained.

In the experiment having been conducted by the inventor, the polishing solution was recycled six times. However, the polishing rate was not deteriorated and a quality in a polished surface of the object 12 was not deteriorated. Hence, it is possible to reduce running costs of the apparatus and reduce environmental load caused by wasting the polishing solution.

In the first embodiment, though the dresser 23 is designed to rotate by itself around a center thereof as the polishing plate 11 rotates, the apparatus may include a unit for rotating the dresser 23. Such a unit makes it possible to vary a relative speed between the polishing surface and the dressing surface of the dresser 23, and rotate the dresser 23 in a direction opposite to the direction A, ensuring that a degree at which the polishing surface is dressed by the dresser 23 can be controlled.

Though not illustrated, the apparatus may further include a fourth unit for reciprocating both the second unit 14 and the dresser 23 in a radius-wise direction of the polishing plate 11. Even if the second unit 14 has a length smaller than a radius of the polishing plate 11 and the dresser 23 has a diameter smaller than a radius of the polishing plate 11, the fourth unit makes is possible to dress a whole area of the polishing surface and to absorb the polishing solution from a whole area of the polishing surface.

The dresser 23 may be integral with the second unit 14 such that they can rotate independently of each other.

Figure 6:
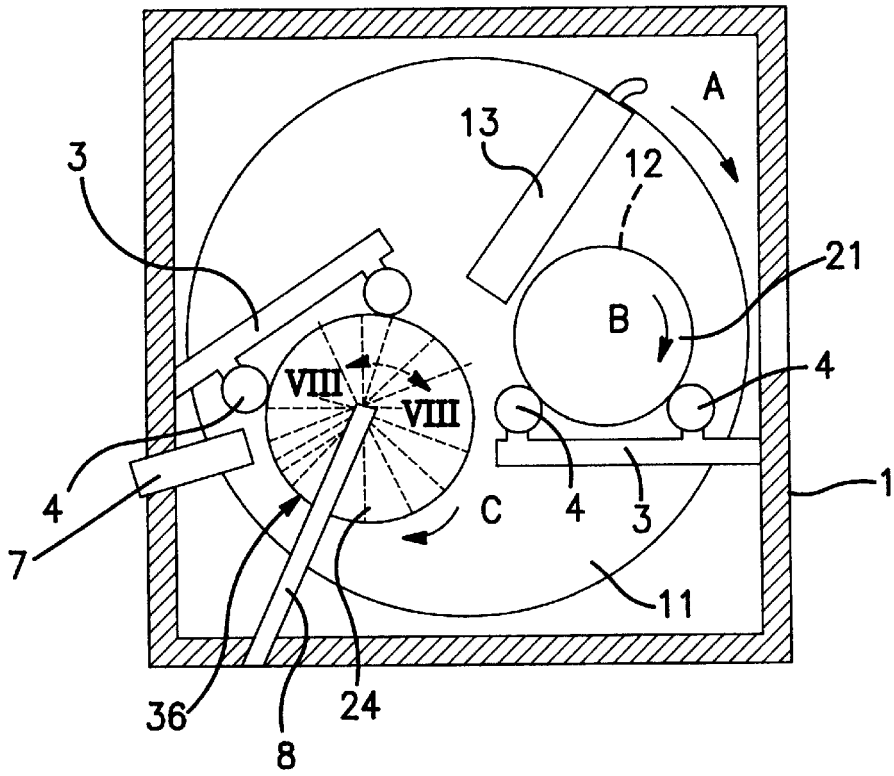
FIG. 6 is a plan view of an apparatus for polishing an object, in accordance with the second embodiment of the present invention.
Figure 7:
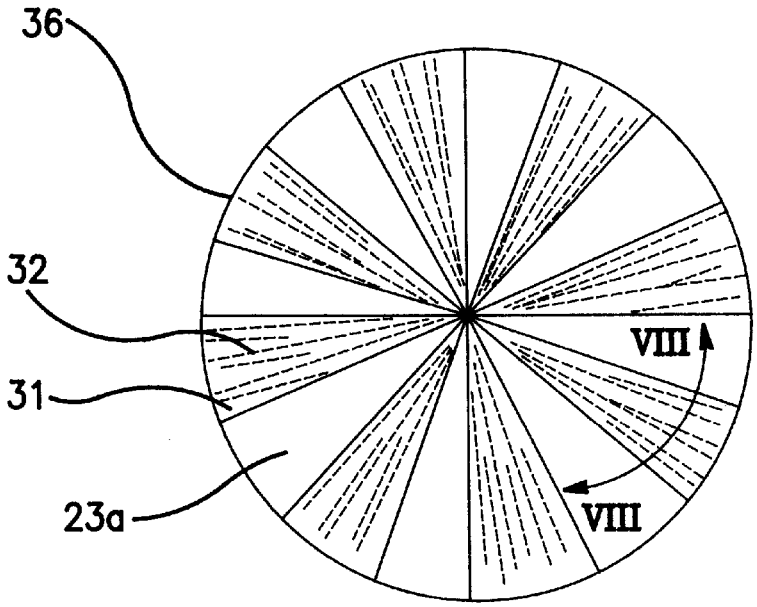
FIG. 7 is a bottom view of a first example of a conditioner to be used in the second embodiment.

FIG. 6 is a plan view of an apparatus for polishing an object, in accordance with the second embodiment. FIG. 7 is a bottom view of a circular conditioner 36 in which the second unit 14 and the dresser 23 are both formed.

The apparatus in accordance with the second embodiment includes the circular conditioner 36 in place of the second unit 14 and the dresser 23 both as separate parts. As illustrated in FIG. 7, the conditioner 36, which faces the polishing plate 11, is designed to have a circular bottom in which 8 absorption surfaces 31 and 8 dressing surfaces 23*a* are formed radially and alternately. The conditioner 36 absorbs the polishing solution through the eight absorption surfaces 31, and dresses the polishing surface through the eight dressing surfaces 23*a*.

Figure 8:
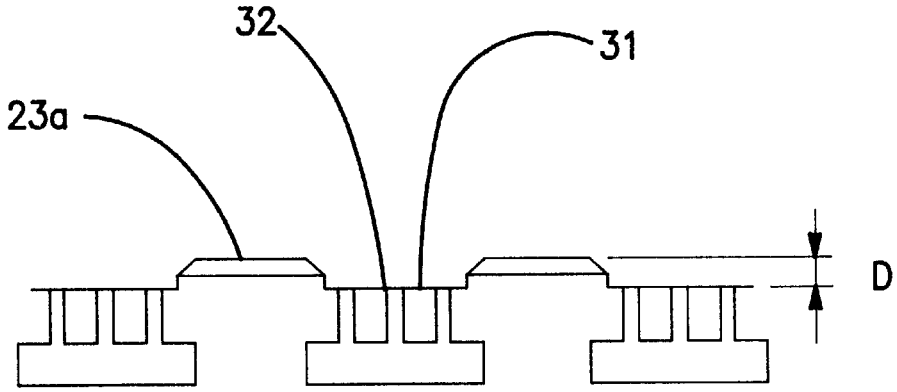
FIG. 8 is a cross-sectional view taken along the line VIII—VIII in FIG. 7.

FIG. 8 is a cross-sectional view taken along the line VIII—VIII in FIG. 7. The dressing surfaces 23*a* are designed to project beyond the absorption surfaces 31 by 0.8 mm. The conditioner 36 is supported by the support rollers 4 on the polishing surface of the polishing plate 11 such that the conditioner 36 can rotate by itself. The support rollers 4 are carried for rotation by a horizontal frame 3 located downstream of the dresser 23 in the direction A.

A hose 8 is connected to the conditioner 36 at a center of the conditioner 36. After used, the polishing solution is absorbed through the hose 8.

The apparatus in accordance with the second embodiment is structurally the same as the apparatus in accordance with the first embodiment except that the apparatus in accordance with the second embodiment includes the conditioner 36 and the hose 8, but does not include the second unit 14, because the conditioner 36 has the absorption surfaces 31. Parts or equivalents corresponding to those in the first embodiment have been provided with the same reference numerals in FIGS. 6 to 8.

Hereinbelow is explained an operation of the apparatus in accordance with the second embodiment.

When the object 12 is to be polished by the polishing plate 11, the first unit 13 supplies the polishing solution onto the polishing surface of the polishing plate 11. The polishing solution supplied to the polishing surface upstream of the object 12 reaches the object 12 by virtue of the rotation of the polishing plate 11. The object 12 is polished by a frictional force generated between the polishing plate 11 and the object 12 by both the rotation of the polishing plate 11 in the direction A and the rotation of the object 12 in the direction B.

After the polishing solution has passed the object 12, the polishing solution is dug from the polishing surface by the dressing surface 23*a* of the conditioner 36 located downstream of the object 12. Herein, the dressing surface 23*a* makes contact with the polishing surface under a pressure of 10 kPa caused a weight of the conditioner 36. Since the conditioner 36 rotates, the thus dug polishing solution is absorbed into the absorption surfaces 31 through the absorption holes 32.

As mentioned above, the polishing solution together with debris of the polishing surface is dug and immediately removed. As a result, the polishing surface is kept clean.

As mentioned so far, the apparatus in accordance with the second embodiment makes it possible to effectively polish the object 12 without reduction in a polishing rate. In accordance with the apparatus, the polishing solution is supplied to a whole area of the polishing surface and the polishing solution is absorbed from a whole area of the polishing surface, ensuring that any object 12 can be polished under the same conditions regardless of a size of the object 12.

In the apparatus, the conditioner 36 is merely set on the polishing surface by the supporting rollers 4 such that the conditioner 36 can rotate by itself Hence, the conditioner 36 can be readily properly set each time the polishing plate 11 is exchanged to a new one.

In accordance with the apparatus, it would be possible to keep an absorption ability of the conditioner 36 constant, even if the polishing plate 11 is worn.

The inventor conducted an experiment to confirm the above-mentioned advantages presented by the apparatus in accordance with the second embodiment.

The experiment was conducted under the same conditions as the conditions in the experiment set forth in the first embodiment. The result was that the polishing rate was 2200±40 angstroms/min when the polishing time was equal to or smaller than 20 hours. Thus, it was confirmed that the problem in the conventional apparatus that the polishing rate became smaller as the polishing time became longer when an object was compressed onto the polishing surface in a high pressure, was solved.

In addition, the conditioner 36 could be properly set in a time twenty times smaller than a time necessary for the conventional apparatus to properly set the second unit 14.

Furthermore, since an absorption ability of the conditioner 36 could be kept constant, a yield in polishing the object 12 was enhanced.

As a result, the apparatus in accordance with the second embodiment could polish the objects 12 in a greater number per a unit time than the conventional apparatus, and accordingly, a throughput was enhanced by 40%.

As mentioned below, various conditioners may be used in place of the above-mentioned conditioner 36.

Figure 9:
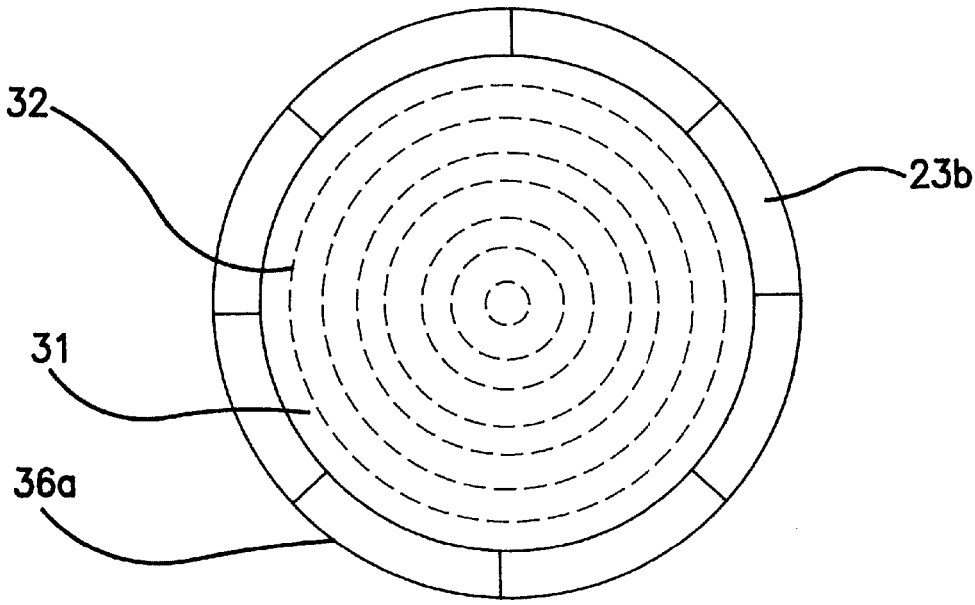
FIG. 9 is a bottom view of a second example of a conditioner to be used in the second embodiment.

For instance, as illustrated in FIG. 9, there may be used a conditioner 36*a* in the form of a circular plate comprised of an annular dressing surface 23*b*, and an absorption surface 31 formed within and integrally with the dressing surface 23*b*.

Figure 10:
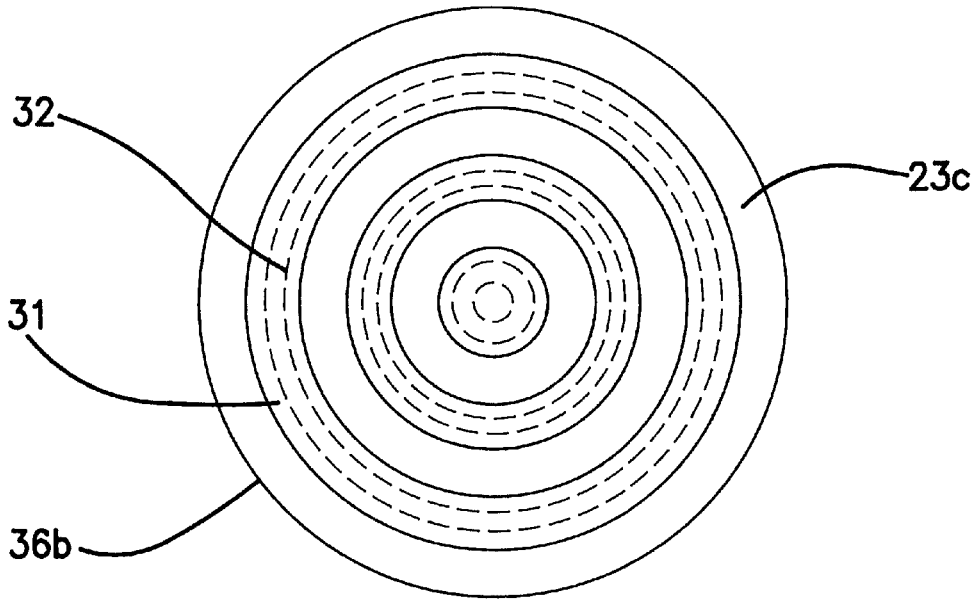
FIG. 10 is a bottom view of a third example of a conditioner to be used in the second embodiment.

As an alternative, as illustrated in FIG. 10, there may be used a conditioner 36*b* in the form of a circular plate comprised of a plurality of annular absorption surfaces 31 and a plurality of annular dressing surfaces 23*c*. The absorption surfaces 31 and the dressing surfaces 23*c* are alternately arranged coaxially with one another.

Figure 11:
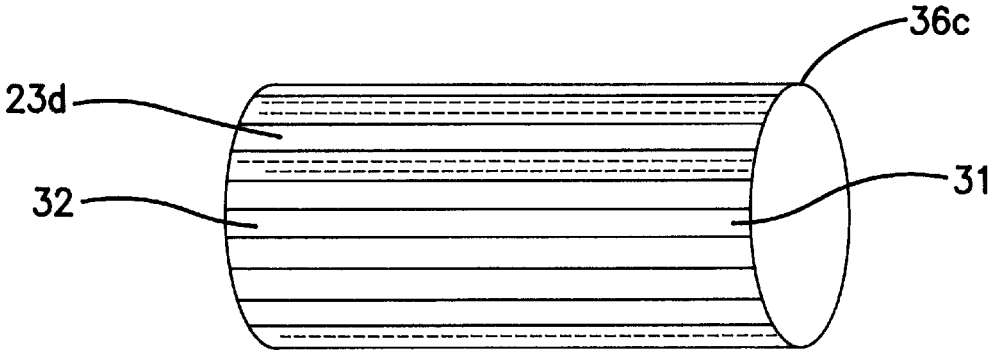
FIG. 11 is a bottom view of a fourth example of a conditioner to be used in the second embodiment.

As illustrated in FIG. 11, there may be used a conditioner 36*c* in the form of a cylinder having an outer surface comprised of dressing surfaces 23*d* extending in an axial direction of the cylinder and absorption surfaces 31 extending in an axial direction of the cylinder. The absorption surfaces 31 and the dressing surfaces 23*d* are axially, alternately arranged on an outer surface of the cylinder.

Figure 12:
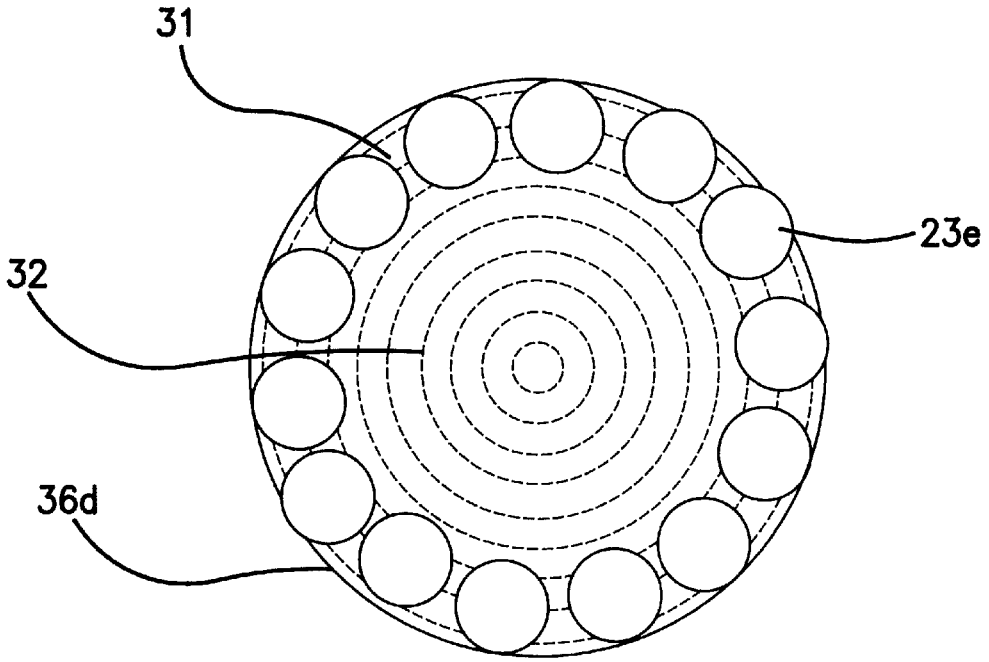
FIG. 12 is a bottom view of a fifth example of a conditioner to be used in the second embodiment.

As an alternative, as illustrated in FIG. 12, there may be used a conditioner 36*d* in the form of a circular plate comprised of a plurality of dressers 23*e* arranged on a certain circumference and an absorption surface 31 having an area other than the dressers 23*e*.

The conditioners 36*a*, 36*b*, 36*c* and 36*d* can be set on the polishing surface each time the polishing plate 11 is exchanged to a new one. Hence, it would be possible to shorten a time necessary for exchanging the polishing plate 11.

In addition, even if the polishing plate 11 is worn, a gap between the polishing surface and the absorption surface can be kept constant, ensuring that an ability of absorbing the polishing solution can be kept constant, and hence, productivity can be enhanced.

Though a wafer on which a silicon dioxide film is formed is used as the object 12 in the above-mentioned first and second embodiments, there may be used a wafer on which a metal wire is formed, a magnetic disc or a glass substrate as the object 12.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2000-000569 filed on Jan. 6, 2000 including specification, claims, drawings and summary is incorporated herein by reference in its entirety.

What is claimed is:

1. An apparatus for polishing an object, comprising:

(a) a rotatable circular polishing plate having a polishing surface on which an object is to be polished;

(b) a pressurizer which applies a pressure to an object to make said object contact with said polishing surface;

(c) a first unit which is located upstream of said object in a direction of rotation of said polishing plate and which supplies polishing solution containing abrasive, to said polishing surface;

(d) a dresser which is located downstream of said object in a direction of rotation of said polishing plate and which dresses said polishing surface; and (e) a second unit which is located downstream of said dresser and upstream of said first unit in a direction of rotation of said polishing plate and which has an absorption surface through which said second unit sucks said polishing solution from said polishing surface, said absorption surface being formed thereon with a plurality of pivots.

2. The apparatus as set forth in claim 1, wherein each of said pivots has a rounded summit.

3. The apparatus as set forth in claim 1, wherein said pivots are formed at four corners of said absorption surface.

4. The apparatus as set forth in claim 1, wherein said pivots are composed of Teflon.

5. The apparatus as set forth in claim 1, wherein said absorption surface is comprised of a first area facing an inner area of said polishing surface, a second area facing an outer area of said polishing surface entirely surrounding said inner area, and an intermediate area located between said first and second areas, said first area having absorption holes in a greater number than said intermediate area and said second area having absorption holes in a greater number than said intermediate area, said polishing solution being absorbed into said second unit through said absorption holes.

6. The apparatus as set forth in claim 1, wherein said absorption surface is formed at opposite edges thereof with a plurality of recesses in a direction of rotation of said polishing plate.

7. The apparatus as set forth in claim 1, wherein said absorption surface is rounded or chamfered at opposite edges thereof in a direction of rotation of said polishing plate.

8. The apparatus as set forth in claim 1, further comprising a unit for rotating said dresser around a center of said dresser.

9. The apparatus as set forth in claim 1, further comprising a unit for upwardly or downwardly moving said second unit relative to said polishing surface.

10. The apparatus as set forth in claim 1, further comprising:

an annular wall standing along a periphery of said polishing plate and rotatable together with said polishing plate; and a third unit which is located inside said annular wall and in the vicinity of an inner surface of said annular wall and which collects said polishing solution.

11. The apparatus as set forth in claim 1, wherein said second unit and said dresser are integrally supported on said polishing surface so that said second unit and said dresser are rotatable together in a direction of rotation of said polishing plate.

12. The apparatus as set forth in claim 1, further comprising a fourth unit which reciprocates said second unit and said dresser together in a direction of a radius of said polishing plate.

13. The apparatus as set forth in claim 1, wherein said second unit has a length equal to a radius of said polishing surface, and said second unit lies above said polishing plate entirely over a radius of said polishing surface.

14. The apparatus as set forth in claim 1, wherein said dresser has a length equal to a radius of said polishing surface, and said dresser lies on said polishing plate entirely over a radius of said polishing surface.

15. The apparatus as set forth in claim 1, further comprising a fifth unit which filters said polishing solution having been absorbed by said second unit, and supplies the thus filtered polishing solution to said first unit.

16. An apparatus for polishing an object, comprising:

(a) a rotatable circular polishing plate with a polishing surface;

(b) a pressurizer which applies a pressure to an object to make said object contact with said polishing surface;

(c) a first unit which is located upstream of said object in a direction of rotation of said polishing plate and which supplies polishing solution containing abrasive, to said polishing surface; and (d) a dresser which is located downstream of said object in a direction of rotation of said polishing plate and which dresses said polishing surface, said dresser including a second unit having an absorption surface through which said second unit sucks said polishing solution from said polishing surface, said absorption surface being formed thereon with a plurality of pivots.

17. The apparatus as set forth in claim 16, wherein said dresser is in the form of a circle.

18. The apparatus as set forth in claim 16, wherein said dresser is formed of a circular plate in which a dressing surface of said dresser and said absorption surface are radially and alternately arranged.

19. The apparatus as set forth in claim 16, wherein said dresser is formed of a circular plate in which said absorption surface is arranged in an inner area of said circular plate and a dressing surface of said dresser is arranged in an outer area surrounding said inner area of said circular plate.

20. The apparatus as set forth in claim 16, wherein said dresser is formed of a circular plate in which a dressing surface of said dresser and said absorption surface are coaxially and alternately arranged.

21. The apparatus as set forth in claim 16, wherein said dresser is formed of a cylinder, a dressing surface of said dresser extending in an axial direction of said cylinder and said absorption surface extending in an axial direction of said cylinder being alternately arranged on an outer surface of said cylinder.

22. The apparatus as set forth in claim 16, wherein said dresser is formed of a circular plate in which a plurality of said dressers are arranged on a certain circumference and an area other than said dressers is formed as absorption surface.

23. The apparatus as set forth in claim 16, wherein a dressing surface of said dresser projects beyond said absorption surface.

24. The apparatus as set forth in claim 23, wherein said dressing surface projects beyond said absorption surface by 1 mm or smaller.

25. The apparatus as set forth in claim 16, wherein each of said pivots has a rounded summit.

26. The apparatus as set forth in claim 16, wherein said pivots are formed at four corners of said absorption surface.

27. The apparatus as set forth in claim 16, wherein said pivots are composed of Teflon.

28. The apparatus as set forth in claim 16, further comprising a unit for rotating said dresser around a center of said dresser.

29. The apparatus as set forth in claim 16, further comprising a unit for upwardly or downwardly moving said second unit.

30. The apparatus as set forth in claim 16, further comprising:

an annular wall standing along a periphery of said polishing plate and rotatable together with said polishing plate; and a third unit which is located inside said annular wall and in the vicinity of an inner surface of said annular wall which collects said polishing solution.

31. The apparatus as set forth in claim 16, wherein said dresser is supported on said polishing surface so that said dresser is rotatable in a direction of rotation of said polishing plate.

32. The apparatus as set forth in claim 16, further comprising a fourth unit which reciprocates said second unit and said dresser together in a direction of a radius of said polishing plate.

33. The apparatus as set forth in claim 16, wherein said dresser has a length equal to a radius of said polishing surface, and said dresser lies on said polishing plate entirely over a radius of said polishing surface.

34. The apparatus as set forth in claim 16, further comprising a fifth unit which filters said polishing solution having been absorbed by said second unit, and supplies the thus filtered polishing solution to said first unit.

* * * * *